US011318429B2

(12) United States Patent
Ren et al.

(10) Patent No.: US 11,318,429 B2
(45) Date of Patent: May 3, 2022

(54) ENCLOSED MIXTURE STIRRER USING INTERMITTENT RESONANCE AND METHOD

(71) Applicant: Northeastern University, Shenyang (CN)

(72) Inventors: Zhaohui Ren, Shenyang (CN); Hongcheng Qiu, Shenyang (CN); Hui Li, Shenyang (CN); Shangqing Li, Shenyang (CN); Huihui Wang, Shenyang (CN); Huaishuai Wu, Shenyang (CN)

( * ) Notice: Subject to any disclaimer, the term of this patent is extended or adjusted under 35 U.S.C. 154(b) by 299 days.

(21) Appl. No.: 16/491,718

(22) PCT Filed: Mar. 6, 2017

(86) PCT No.: PCT/CN2017/075711
§ 371 (c)(1),
(2) Date: Sep. 6, 2019

(87) PCT Pub. No.: WO2018/161204
PCT Pub. Date: Sep. 13, 2018

(65) Prior Publication Data
US 2021/0129094 A1 May 6, 2021

(51) Int. Cl.
*B01F 11/02* (2006.01)
*B01F 15/00* (2006.01)
*B01F 11/00* (2006.01)

(52) U.S. Cl.
CPC ..... *B01F 11/0031* (2013.01); *B01F 11/0008* (2013.01); *B01F 11/0097* (2013.01); *B01F 11/0275* (2013.01); *B01F 15/00733* (2013.01)

(58) Field of Classification Search
CPC ..... B01F 11/0031; B01F 11/0008; B01F 11/0097; B01F 13/0033; B01F 15/00733; B01F 11/0275; C12M 33/08
(Continued)

(56) References Cited

U.S. PATENT DOCUMENTS 2,875,989 A * 3/1959 Toulmin, Jr. ..... A47J 43/042 366/114
3,089,582 A * 5/1963 Musschoot ..... B65G 27/20 198/761

(Continued)

*Primary Examiner* — Tony G Soohoo
(74) *Attorney, Agent, or Firm* — Novoclaims Patent Services LLC; Mei Lin Wong

(57) ABSTRACT

Provided are an enclosed stirrer using intermittent resonance and a method. The enclosed stirrer comprises: two pairs of parallel tension springs (1), a fixing bracket (2), an elastic cantilever beam (3), a cantilever beam pressure clamping device (6), an eccentric motor (4), an arc-shaped cushion block (5), and an enclosed container (8). The enclosed container (8) is mounted on the fixing bracket (2) by the tension spring (1). The elastic cantilever beam (3) is installed below the enclosed container (8) and is axially parallel to the enclosed container (8). One end of the elastic cantilever beam (3) is mounted on the fixing bracket (2) as a clamping end, the other end of the elastic cantilever beam (3) is connected to the eccentric motor (4) as a movable end. The arc-shaped cushion block (5) is connected above the eccentric motor (4). The arc-shaped cushion block (5) reciprocally strikes the bottom of the enclosed container (8) during operation of the eccentric motor (4).

14 Claims, 5 Drawing Sheets

(58) Field of Classification Search
USPC ..... 366/108, 111, 112, 114, 115, 128, 127
See application file for complete search history.

(56) References Cited

U.S. PATENT DOCUMENTS 3,130,831 A * 4/1964 Musschoot ..... B65G 27/00 198/770
3,203,264 A * 8/1965 Evans ..... B06B 1/16 74/61
3,212,345 A * 10/1965 Rechenberg ..... B65G 27/28 74/87
3,348,664 A * 10/1967 Renner ..... B65G 27/20 198/761
3,622,286 A * 11/1971 Gaddy ..... B24B 31/06 451/113
3,687,420 A * 8/1972 Schweinfurth ..... B65G 27/04 366/109
3,812,625 A * 5/1974 Olson ..... B24B 31/06 451/326
3,926,733 A * 12/1975 Chibata ..... C12M 23/48 435/34
4,004,883 A * 1/1977 Meyer ..... B01F 11/0014 422/566
4,037,368 A * 7/1977 Kerwin ..... B24B 31/06 451/33
4,040,303 A * 8/1977 Makino ..... B65G 27/18 74/61
4,422,768 A * 12/1983 Solomon ..... B01F 11/0031 366/110
4,556,639 A * 12/1985 Izawa ..... C12M 23/10 366/240
5,250,261 A * 10/1993 Porte ..... G01N 35/1004 422/63
5,544,683 A * 8/1996 Guhl ..... B06B 1/18 141/65
5,547,068 A * 8/1996 Spurlin ..... B65G 27/26 198/760
5,608,693 A * 3/1997 Richards ..... B01F 11/0005 366/114
5,769,538 A * 6/1998 Sherman ..... B01F 11/0008 366/198
6,059,446 A * 5/2000 Dschida ..... B01F 11/0008 366/208
6,390,660 B1 * 5/2002 Colin ..... B01F 13/0809 366/108
7,204,637 B2 * 4/2007 Sherman ..... B01F 9/0021 366/214
7,210,843 B2 * 5/2007 Friedman ..... B01F 11/0034 366/110
7,461,650 B1 * 12/2008 Rand ..... A61M 15/009 128/200.14
9,248,452 B2 * 2/2016 Hart ..... B01F 9/0021
9,695,392 B2 * 7/2017 Sherman ..... C12M 27/16
9,938,494 B2 * 4/2018 Watakabe ..... C12M 33/08
10,767,725 B2 * 9/2020 Amruthnath ..... G01M 7/02

* cited by examiner

ENCLOSED MIXTURE STIRRER USING INTERMITTENT RESONANCE AND METHOD

BACKGROUND OF THE PRESENT INVENTION

Field of Invention

The present invention relates to an application of vibration in the agricultural, chemical, food and construction industries, and more particularly to an enclosed stirrer utilizing intermittent resonance of liquid and solid mixture, liquid and liquid mixture, solid and solid mixture.

Description of Related Arts

With the continuous upgrading of agricultural mechanization, the shortcomings of traditional agricultural fertilization techniques have gradually been exposed. The cumbersome manual fertilization operation has adversely affected agricultural production. Improving agricultural production methods has become a symbol of modern agriculture. Using liquid fertilizers for fertilization in agricultural production can reduce labor intensity and production cost and improve the production level of agriculture. Also, because liquid fertilizer is often accompanied by a large amount of solid sediment, which cannot be fully dissolved in water by stirring, the application of fertilizer becomes uneven and thus reduced crop yield is resulted.

At the same time, the mixing quality of liquid and liquid mixtures in the chemical industry is continuously improved. In order to achieve the desired degree of mixing, to promote chemical reactions and to accelerate physical changes, it is sometimes necessary to continuously operate the stirring equipment for one week or even several days, this puts higher and higher requirements on the energy consumption index of the mixing machinery.

In addition, the food industry and the construction industry usually need to uniformly mix various solid and solid mixtures. For example, in order to improve the manufacturing quality and increase the production efficiency of the building construction, the requirements for uniform mixing of raw materials such as mud, sand and gravel are getting higher and higher; in order to manufacture foods that meet the consumer tastes, there are also strict requirements for mixing uniformity of different kinds of flours, seasoning powders and additive materials.

At present, people have already conducted in-depth research on the mixture stirrer, but there are still some problems. Patent CN201410675963.1, patent CN 201310108093.5, patent CN201210478155.7, and patent CN 201320112977.3 are different experimental ideas. However, in principle, the rotation of the stirring body is employed and the rotational movement of the stirring body is controlled for mixing the materials. The structure is complex, the function is single and the scope of application is extremely limited, which is only applicable to the stirring processing of specific raw materials. The requirements on the form, viscosity and impurity content of raw materials are relatively high and there are drawbacks such as cumbersome installation process, uneven mixing under large-scale production, and high energy consumption. The patent CN201310293240.0 employs the method of electromagnetic stirring. However, the requirements on the conductivity of the liquid raw material is relatively high, and the equipment cost is high. In view of the actual needs of the above various industries and the problems existing in the existing mixing equipment, the present invention skillfully utilizes the idea of intermittent resonance, and designs a novel mixture enclosed mixer which is energy-saving, environmentally friendly, low cost and simple in structure.

SUMMARY OF THE PRESENT INVENTION

In order to overcome the disadvantages of the conventional arts, the present invention provide an enclosed stirring machine using intermittent resonance.

The present invention is implemented by the following technical solutions:

An enclosed stirring machine for mixture materials using intermittent resonance, characterized in that: comprising: two pairs of tension springs which are parallel to each other, a fixed support frame an elastic cantilever beam, a cantilever pressure clamping device, an eccentric motor, a curve-shaped cushion pad, an enclosed container, the particular structure is as follows:

the enclosed container is mounted to the fixed support frame by the tension springs, the elastic cantilever beam is mounted below the enclosed container and is parallel to an axial direction of the enclosed container, the elastic cantilever beam has one end serving as a clamping end and mounting to the fixed support frame and another end serving as a movable end and connecting to the eccentric motor, the eccentric motor has a top side connected to the curve-shaped cushion pad, the curve-shaped cushion pad reciprocally hits a bottom side of a tail portion of the enclosed container during an operation of the eccentric motor.

According to the enclosed stirring machine for mixture materials using intermittent resonance, the fixed support frame comprises: a pair of parallel support cantilevers, four parallel support vertical beams, two parallel support side beams, a fixed plate and four weight blocks;

the four support vertical beams are perpendicular to the ground, the two support side beams are axially parallel to the enclosed container and are connected between the support vertical beams, the fixed plate is radially parallel to the enclosed container and is connected between the support vertical beams, the four weight blocks are mounted at a bottom of the four support vertical beams respectively, the two pairs of tension springs has one end mounted on the support cantilevers.

According to the enclosed stirring machine for mixture materials using intermittent resonance, the two support vertical beams are connected by the support cantilever therebetween at top ends of the support vertical beams and at one end of the two support side beams, one pair of the tension springs have one end fixed on the support cantilever at the one end of the two support side beams; two the support vertical beams are connected by the support cantilever therebetween at top ends of the support vertical beams and at another end of the two support side beams, another one pair of the tension springs have one end fixed on the support cantilever at the another end of the two support side beams.

According to the enclosed stirring machine for mixture materials using intermittent resonance, the one pair of parallel support cantilever, the four parallel support vertical beams and the two parallel support side beams of the fixed support frame are made of steel, the fixed plate is made of solid steel plate and is welded between the two support vertical beams.

The enclosed stirring machine for mixture materials using intermittent resonance further comprises a thin-walled cylinder body having one closed end at one end and one opening at another end; the closed end of the thin-walled cylinder body has a fertilizer input port and a water input port, the another end with the opening of the thin-walled cylinder body has is mounted with a closed tapered outlet, each of the two ends of the thin-walled cylinder body are connected to one pair of the tension springs respectively, and each one pair of the tension springs are mounted on the thin-walled cylinder body at a distance of a diameter of one end surface of the thin-walled cylinder body, the thin-walled cylinder body is made of transparent materials.

The enclosed stirring machine for mixture materials using intermittent resonance further comprises a cart, the fixed support frame is placed on the cart; the cart comprises: a loading plate, a cart handle, a universal caster, a fixed brake caster, the fixed brake caster is mounted at one side of and below the loading plate, the universal caster is mounted at another side of and below the loading plate, the cart handle is mounted at one side of the loading plate, the fixed support frame is placed on the cart.

The enclosed stirring machine for mixture materials using intermittent resonance, further comprises a cantilever pressure clamping device, the cantilever pressure clamping device is mounted on the fixed plate of the fixed support frame, the clamping end of the elastic cantilever beam is pressed tightly by the cantilever pressure clamping device, the movable end of the elastic cantilever beam is suspended directly below the enclosed container.

The mixing method by the enclosed stirring machine using intermittent resonance, comprising:

Step 1: obtain a total natural frequency F' of a material with a height H and the enclosed container;

Step 1-1: transport water and raw materials at liquid state to the enclosed container until reaching a preset height H, at this time block the tapered outlet of the enclosed container;

Step 1-2: obtain the total natural frequency F' of the enclosed container and the liquid with a height H based on a suspension spring stiffness K, a height H of the liquid inside the enclosed container, a mass M of the enclosed container, and based on $$F = \frac{1}{2\pi}\sqrt{\frac{K}{M + m_{Liquid}}}$$

and $$m_{Liquid} = \rho_{Liquid} d\left(r^2 \arccos\frac{r-H}{r} - \sqrt{2rH - H^2}\,(r-H)\right),$$

where $\rho_{liquid}$ refers to a density of liquid inside the enclosed container, d refers to a length of the thin-walled cylinder body of the enclosed container, r refers to inner cavity radius of the enclosed container;

Step 1-3: If the raw material being added is a mixture of liquid and solid or a mixture of solid and solid, the mixture can be weighed first and the total mass after mixing can be obtained, then the total natural frequency can be obtained by using formula $$F = \frac{1}{2\pi}\sqrt{\frac{K}{M + m_{total}}};$$

Step 2: based on R=60F, determine the real-time rotational speed R of the eccentric motor; establish a relationship between the rotational speed R and the height H of the raw materials inside the enclosed container by the step 1, and calibrate height values for the thin-walled cylinder body of the enclosed container, if the mixture inside the enclosed container is solid, a relationship between the height of the container and the rotational speed of the eccentric motor can be determined by field test according to a size and mass of the thin-walled cylinder body and the mass of the solid mixture contained therein;

Step 3: determine a length L of the suspending cantilever beam;

Step 3-1: obtain a total mass m of the eccentric motor and the curve-shaped cushion pad through measuring test;

Step 3-2: determine the length L of the suspending cantilever beam according to the formula $$F = \frac{1}{2\pi}\sqrt{\frac{3EJ}{L^3 m}},$$

where E is the elastic modulus of the suspending cantilever beam, J is the moment of inertia of the section since the natural frequency of the elastic cantilever beam needs to be equal to the total natural frequency F of the enclosed container and the contained materials, then adjust the cantilever pressure clamping device so that the length of the elastic cantilever beam at its vibration end is the determined value L;

Step 4: After setting the above parameters, the on/off switch of the eccentric motor is activated so that a preset rotational speed R is reached, then the elastic cantilever beam will reach a resonance state, and through the curve-shaped cushion pad at the end of the elastic cantilever beam reciprocally hits the enclosed container at the tail end and at the bottom side, the enclosed container is shaken up and down for providing a stirring effect, and after a period of time, a stable up and down shaking and stirring state will be reached;

Step 5: Turn off the on/off switch of the eccentric motor, determine the optimal control coefficient through actual tests so as to control an intermittent power-on time $\tau$ of the eccentric motor;

Step 5-1: measure the time t required from turning off of the eccentric motor to attenuation of the elastic cantilever beam to an amplitude of 0 at a point after the on/off switch of the eccentric motor is turned off and the elastic cantilever beam is free to attenuate the vibration, Step 5-2: Set the intermittent power-on time $\tau$ of the eccentric motor; according to $\tau \neq t$, $\tau = at$, where a refers to control coefficient and its value is ($0.8 \leq a \leq 1.2$), determine the optimal value of the control coefficient $a_{fit}$ through processing actual test, then determine the intermittent power-on time $\tau$ of the eccentric motor;

Step 6: Turn on the eccentric motor again so that it will start to operate at a rotational speed R, through the elastic cantilever beam hitting on the enclosed container until the enclosed container is shaking up and down steadily while the raw materials are stirred uniformly, open the tapered outlet of the enclosed container, in the process of feeding raw materials, through observing the decrease in height H of the raw materials, real-time observe the height H of the liquid level of the thin-walled cylinder body according to step 2 to adjust the rotational speed of the eccentric motor, and the intermittent power-on time $\tau$ of the eccentric motor is used to control the on and off of the eccentric motor to achieve the purpose of intermittent resonance and materials feeding.

The present invention has the following advantageous technical effects:

1. The present invention provides an enclosed stirring machine for mixture materials using intermittent resonance. The idea of intermittent resonance is skillfully integrated into the design of the enclosed stirring machine for mixture materials, which effectively solves the problems of not energy-saving and not environmentally friendly and incomplete stirring in the existing art.

2. The present invention has the advantages of low cost and simple structure. Since the length of the cantilever end of the elastic cantilever beam can be adjusted, the natural frequency of the vibration can be adjusted. Therefore by utilizing the amplitude of the elastic cantilever beam after resonance amplification to excite the thin-walled enclosed container can also achieve a relatively larger amplitude of up and down shaking state, thus resulting an energy-saving and environmentally friendly effect.

3. By controlling the intermittent power-on time of the eccentric motor, the use of minimal electrical energy to maintain the enclosed container to achieve a large amplitude of up and down shaking state is realized and so the purpose of energy saving and environmental protection is achieved.

Figure 1:
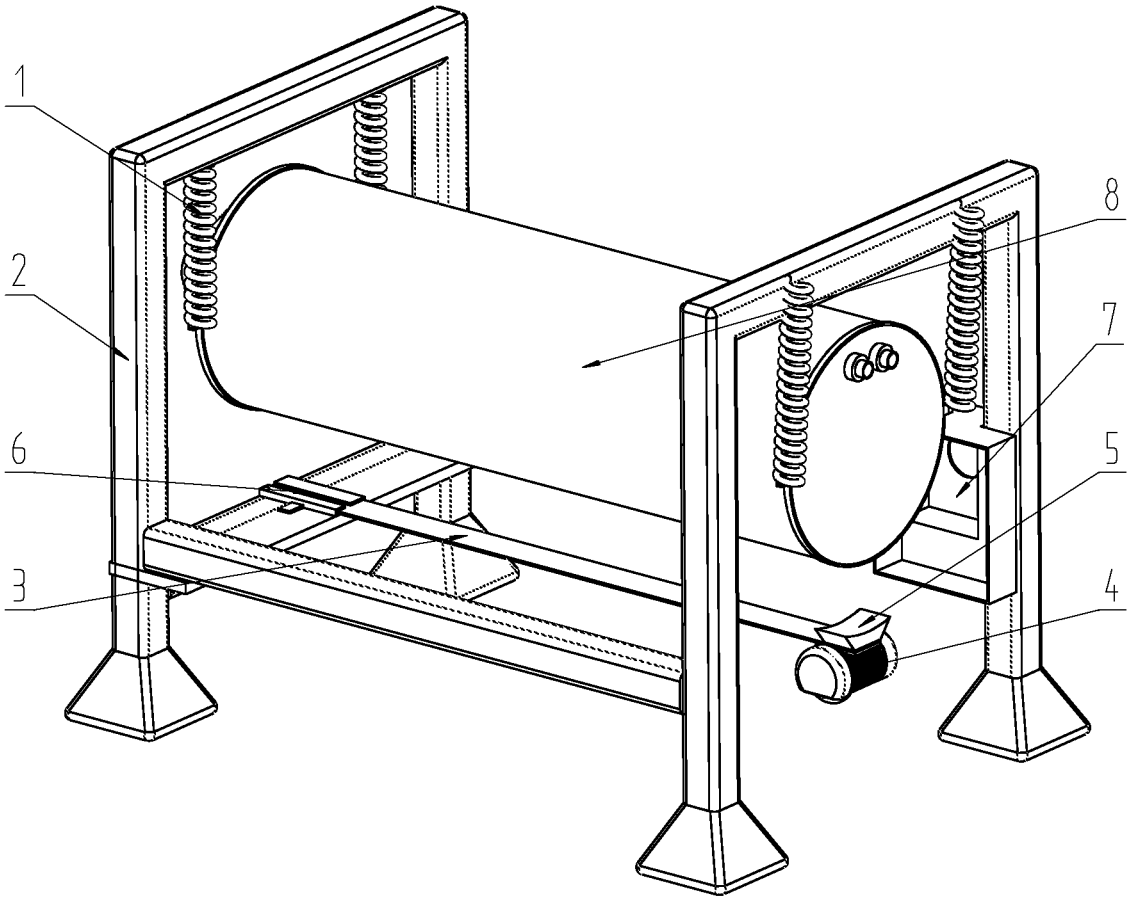
FIG. 1 is a schematic diagram of an enclosed stirring machine for mixture materials using intermittent resonance according to an embodiment 1 of the present invention.

In the drawings: 1: tension springs; 2: fixed support frame; 2-1: support cantilevers; 2-2: support vertical beams; 2-3: support side beam; 2-4: fixed plate; 2-5: weight blocks; 3: elastic cantilever beam; 4: eccentric motor; 5: curve-shaped cushion pad; 6: cantilever pressure clamping device; 7: electronic control box; 8: enclosed container; 8-1: thin-walled cylinder body; 8-2: fertilizer input port; 8-3: water input port; 8-4: closed tapered outlet; 9: cart; 9-1: loading plate; 9-2: cart handle; 9-3-1: universal caster; 9-3-3, 9-3-4: fixed brake casters.

DETAILED DESCRIPTION OF THE PREFERRED EMBODIMENT

The present invention is described in further detail with the accompany drawings with reference to specific embodiments of the present invention as follows:

Embodiment 1

As shown in FIG. 1, this embodiment provides an enclosed stirring machine using intermittent resonance, which comprises: two pairs of parallel tension springs 1, a fixed support frame 2, an elastic cantilever beam 3, an eccentric motor 4, a rubber curve-shaped cushion pad 5, and a thin-walled enclosed container 8. For the eccentric motor 4, the model YZU AC three-phase asynchronous vibration motor is selected.

The enclosed container 8 is mounted to the fixed support frame 2 by the tension springs 1. The elastic cantilever beam 3 is mounted below the enclosed container 8 and is parallel to the axial direction of the enclosed container 8. The elastic cantilever beam 3 has one end serving as a clamping end and mounting to the fixed support frame 2 and another end serving as a movable end and connecting to the eccentric motor 4. The eccentric motor 4 has a top side connected to the curve-shape block 5. The curve-shaped cushion pad 5 reciprocally hits a bottom side of a tail portion of the enclosed container 8 during the operation of the eccentric motor 4.

Embodiment 2

As shown in FIG. 1, in addition to the enclosed stirring machine using intermittent resonance according to embodiment 1, this embodiment further comprises an electronic control box 7 mounted on the fixed support frame 2. The lines and switches of the eccentric motor 4 are placed inside the electronic control box 7.

Figure 2:
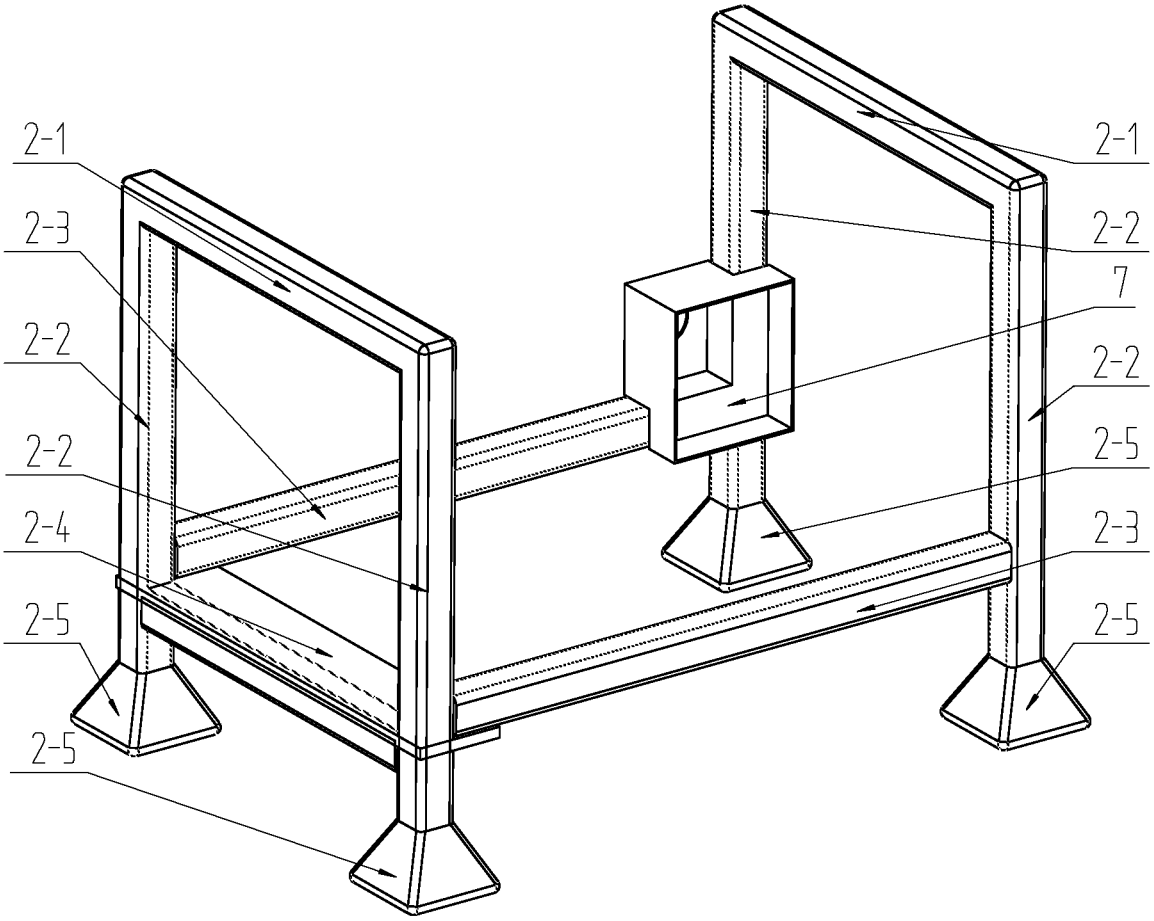
FIG. 2 is a schematic diagram of a fixed support frame according to an embodiment 2 of the present invention.

As shown in FIG. 2, the fixed support frame 2 comprises: a pair of parallel support cantilevers 2-1, four parallel support vertical beams 2-2, two parallel support side beams 2-3, a fixed plate 2-4 and four weight blocks 2-5.

The four support vertical beams 2-2 are perpendicular to the ground, the two support side beams 2-3 are axially parallel to the enclosed container 8 and are connected between the support vertical beams 2-2. The fixed plate 2-4 is radially parallel to the enclosed container 8, connected between two support vertical beams and positioned at one end of the support side beams 2-3. The four weight blocks 2-5 are mounted at a bottom of the four support vertical beams 2-2 respectively. The top ends of the two support vertical beams 2-2 located at one end of the two support side beams 2-3 are connected by the support cantilever 2-1 at the one end. One end of one pair tension springs 1 are fixed on one side of one support cantilever 2-1 at the one end. The top ends of the two support vertical beams 2-2 located at another end of the two support side beams 2-3 are connected by the support cantilever 2-1 at another end. One end of another pair tension springs 1 are fixed on one side of one support cantilever 2-1 at the another end. The pair of parallel support cantilever 2-1, the four parallel support vertical beams 2-2, and the two parallel support side beams 2-3 are made of steel. The fixed plate 2-4 is made of solid steel plate welded between the two support vertical beams 2-2.

Figure 3:
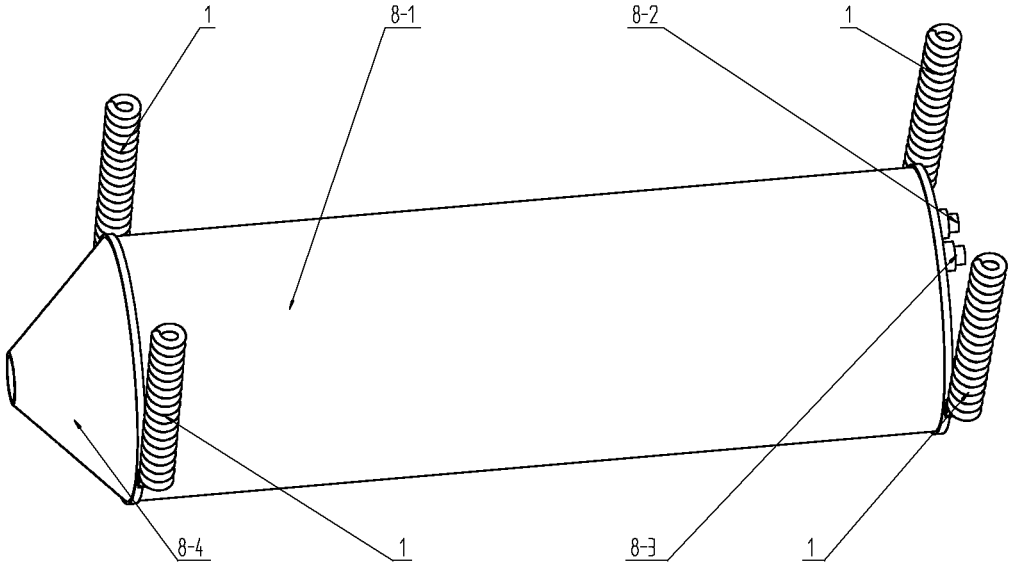
FIG. 3 is a schematic diagram of an enclosed container according to the embodiment 2 of the present invention.

As shown in FIG. 3, the enclosed container 8 comprises: a thin-walled cylinder body 8-1 having one closed end at one end and one opening at another end. The closed end of the thin-walled cylinder body 8-1 has a fertilizer input port 8-2 and water input port 8-3. The thin-walled cylinder body 8-1 is mounted with a closed tapered outlet 8-4 at the another end opposite to the closed end. The two ends of the thin-walled cylinder body 8-1 are connected to one pair tension springs 1 respectively, and each pair of the tension springs 1 are mounted on the thin-walled cylinder body 8-1 at a distance of a diameter of one end surface of the thin-walled cylinder body 8-1. The fertilizer input port 8-2 and the water input port 8-3 are arranged to connect to a fertilizer source and a water source through rubber tubes respectively.

Embodiment 4

Figure 4:
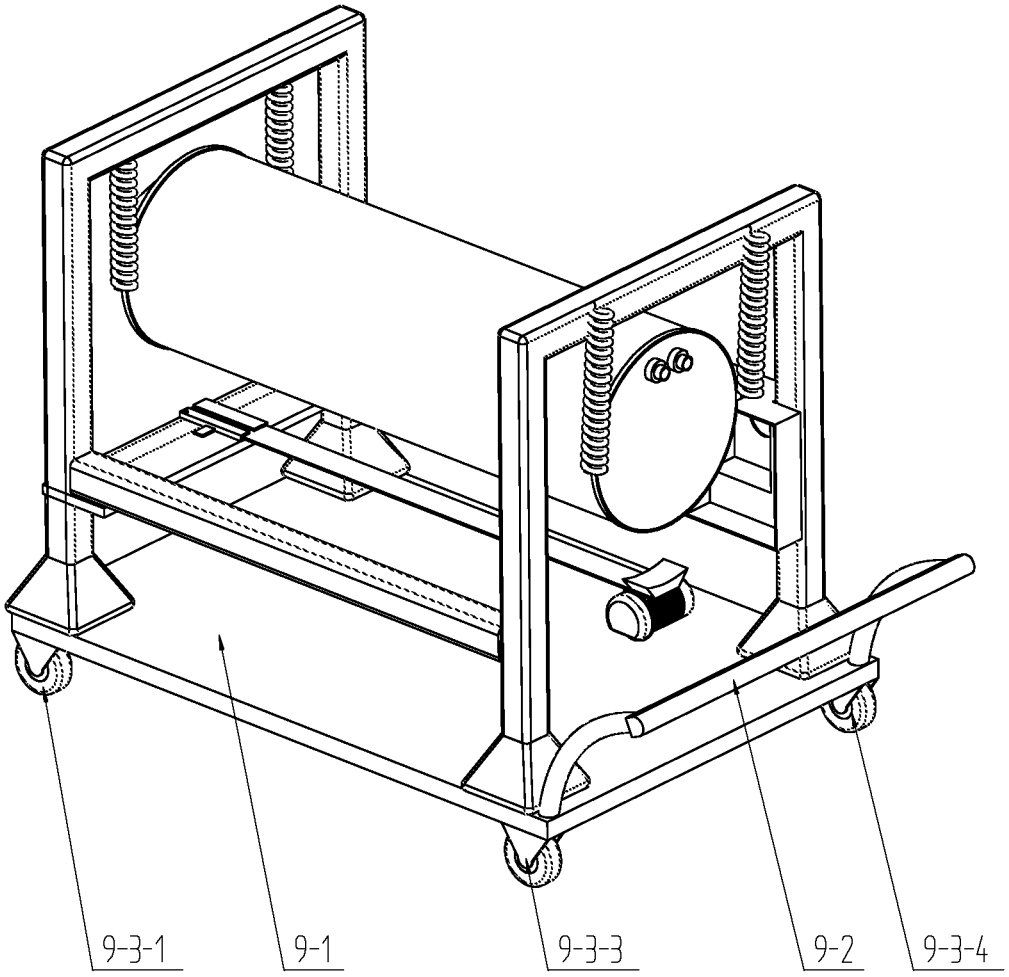
FIG. 4 is a schematic diagram of an enclosed stirring machine for mixture materials using intermittent resonance according to an embodiment 3 of the present invention.

This embodiment provides an enclosed stirring machine using intermittent resonance as shown in FIG. 4. In addition to the enclosed stirring machine using intermittent resonance according to embodiment 1 or 2, the machine further comprises a four-wheeled cart 9. The fixed support frame 2 is placed on the cart 9. The cart 9 comprises: a loading plate 9-1, a cart handle 9-2, a universal caster 9-3-1, two fixed brake casters 9-3-3, 9-3-4. The two fixed brake casters 9-3-3, 9-3-4 are mounted at one end of the loading plate 9-1 at two opposing sides and at a bottom portion. The two universal casters 9-3-1, 9-3-2 (not shown in the drawings) are mounted at another end of the loading plate 9-1 at two opposing sides and at a bottom portion. The cart handle 9-2 is mounted on one side of the loading plate 9-1. The fixed support frame 2 is placed on the cart 9.

Figure 5:
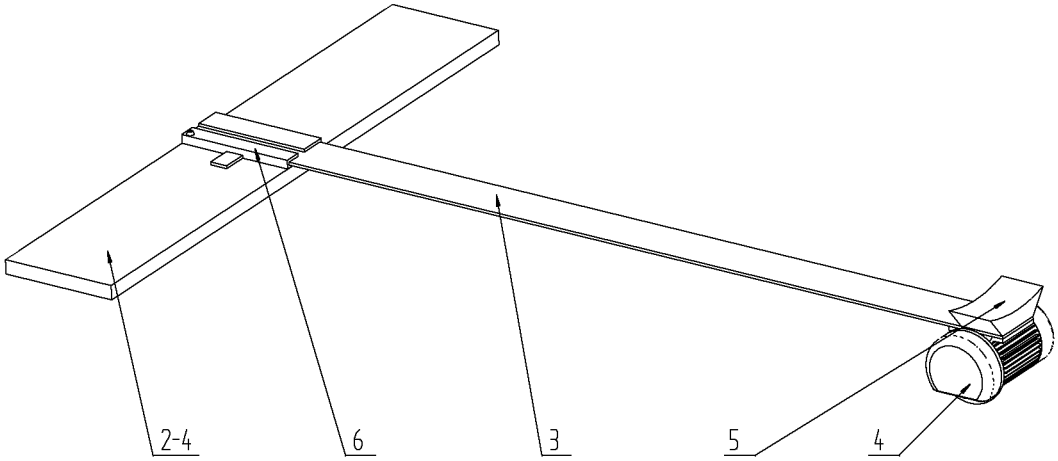
FIG. 5 is a schematic diagram showing the mounting of the cantilever pressure clamping device according to an embodiment 3 of the present invention.
Figure 6:
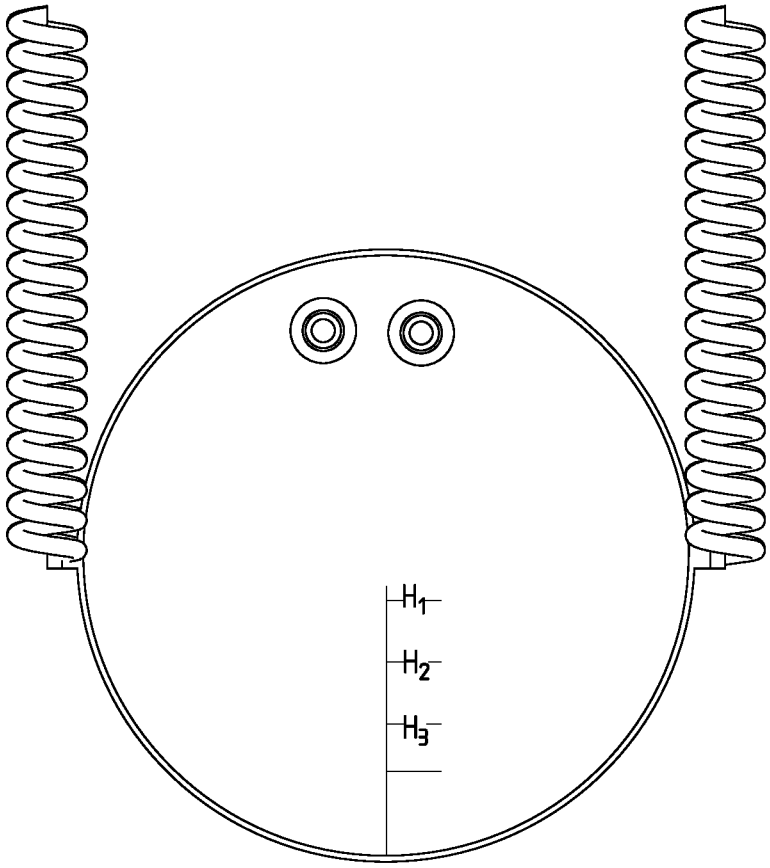
FIG. 6 is a schematic diagram of the H-value calibration of the thin-walled cylinder body of the enclosed container of FIG. 3.

As shown in FIG. 5, the enclosed stirring machine using intermittent resonance further comprises a cantilever pressure clamping device 6. The cantilever pressure clamping device 6 is mounted on the fixed plate 2-4 of the fixed support frame 2. The clamping end of the elastic cantilever beam 3 is pressed tightly by the cantilever pressure clamping device 6. The movable end of the elastic cantilever beam 3 is suspended directly below the enclosed container 8.

In embodiments 1 to 3, the present invention further includes a stirring method using the enclosed stirring machine using intermittent resonance, which comprises:

Step 1: obtain a total natural frequency F' of a material with a height H and the enclosed container;

Step 1-1: transport water and raw materials (liquid state at this point) to the enclosed container until reaching a specific height H, at which time the tapered outlet of the enclosed container is blocked;

Step 1-2: based on a stiffness of suspension spring K, a height of the liquid in the enclosed container H, a mass of the enclosed container M, and according to $$F = \frac{1}{2\pi}\sqrt{\frac{K}{M + m_{Liquid}}},$$

and $$m_{Liquid} = \rho_{Liquid} d\left(r^2 \arccos\frac{r-H}{r} - \sqrt{2rH - H^2}\,(r-H)\right),$$

where $\rho_{Liquid}$ refers to a density of liquid inside the enclosed container, d refers to a length of the thin-walled cylinder body of the enclosed container, r refers to inner cavity radius of the enclosed container, obtain the total natural frequency F' of the enclosed container and the liquid with a height H;

Step 1-3: If the added raw material is a mixture of liquid and solid or solid and solid, the mixture can be weighed first and the total mass after mixing can be obtained, then the total natural frequency can be obtained by using formula $$F = \frac{1}{2\pi}\sqrt{\frac{K}{M + m_{total}}};$$

Step 2: According to R=60F, determine the real-time rotating speed R of the eccentric motor; establish the relationship between the rotating speed R and the height H of the raw materials inside the enclosed container by the step 1, and calibrate height values for the thin-walled cylinder body of the enclosed container, if the mixture inside the enclosed container is solid, the relationship between the height of the container and the rotational speed of the eccentric motor can be determined by field test according to the size and mass of the thin-walled cylinder body and the mass of the solid mixture contained therein;

Step 3: determine a length L of the suspending cantilever beam;

Step 3-1: obtain a total mass m of the eccentric motor and the curve-shaped cushion pad obtained by testing;

Step 3-2: since the natural frequency of the elastic cantilever beam needs to be equal to the total natural frequency F of the enclosed container and the contained materials, so according to the formula $$F = \frac{1}{2\pi}\sqrt{\frac{3EJ}{L^3 m}},$$

where E is the elastic modulus of the suspending cantilever beam, J is the moment of inertia of the section, the length L of the suspending cantilever beam is determined, thereby adjusting the cantilever pressure clamping device, so that the length of the elastic cantilever beam at its vibration end is a certain value L;

Step 4: After setting the above parameters, the on/off switch of the eccentric motor is activated so that a preset rotational speed R is reached, then the elastic cantilever beam will reach the resonance state, and the curve-shaped cushion pad at the end of the elastic cantilever beam reciprocally hits the enclosed container at the tail end and at the bottom side, and the enclosed container will shake up and down for providing a stirring effect, and after a period of time, a stable up and down shaking and stirring state will be reached;

Step 5: Turn off the switch of the eccentric motor, determine the optimal control coefficient through actual tests so as to control the intermittent power-on time τ of the eccentric motor;

Step 5-1: When the switch of the eccentric motor is turned off, the elastic cantilever beam will be free to attenuate the vibration. At this point, measure the time t required from the turning off of the eccentric motor to the attenuation of the elastic cantilever beam to the amplitude of 0.

Step 5-2: Set the intermittent power-on time τ of the eccentric motor; according to τ≠t, τ=at, where a refers to control coefficient and its value is (0.8≤a≤1.2), need to process actual test to determine the optimal value of the control coefficient $a_{fit}$, then to determine the intermittent power-on time τ of the eccentric motor;

Step 6: Turn on the eccentric motor again so that it will start to operate at a rotational speed R. Through the hitting of the elastic cantilever beam on the enclosed container, when the enclosed container is shaking up and down steadily while the raw materials are stirred uniformly, open the tapered outlet of the enclosed container, in the process of feeding raw materials, through observing the decrease in height H of the raw materials, and real-time observe the height H of the liquid level of the thin-walled cylinder body according to step 2 to adjust the rotational speed of the eccentric motor, and the intermittent power-on time τ of the eccentric motor is used to control the on and off of the eccentric motor to achieve the purpose of intermittent resonance and materials feeding.

What is claimed is:

1. An enclosed stirring machine for mixture materials using intermittent resonance, characterized in that: comprising: two pairs of tension springs which are parallel to each other, a fixed support frame, an elastic cantilever beam, a cantilever pressure clamping device, an eccentric motor, a curve-shaped cushion pad, and an enclosed container, wherein said enclosed container is mounted to the fixed support frame by the tension springs, said elastic cantilever beam is mounted below said enclosed container and is parallel to an axial direction of said enclosed container, said elastic cantilever beam has one end serving as a clamping end and mounting to said fixed support frame and another end serving as a movable end and connecting to said eccentric motor, said eccentric motor has a top side connected to said curve-shaped cushion pad, said curve-shaped cushion pad reciprocally hits a bottom side of a tail portion of said enclosed container during an operation of said eccentric motor.

2. The enclosed stirring machine for mixture materials using intermittent resonance according to claim 1, characterized in that: the fixed support frame comprises: a pair of parallel support cantilevers, four parallel support vertical beams, two parallel support side beams, a fixed plate and four weight blocks;

said four support vertical beams are perpendicular to the ground, said two support side beams are axially parallel to said enclosed container and are connected between said support vertical beams, said fixed plate is radially parallel to said enclosed container and is connected between said support vertical beams, said four weight blocks are mounted at a bottom of said four support vertical beams respectively, said two pairs of tension springs has one end mounted on said support cantilevers.

3. The enclosed stirring machine for mixture materials using intermittent resonance according to claim 2, characterized in that: said two support vertical beams are connected by said support cantilever therebetween at top ends of said support vertical beams and at one end of said two support side beams, one pair of said tension springs have one end fixed on said support cantilever at said one end of said two support side beams;

two said support vertical beams are connected by said support cantilever therebetween at top ends of said support vertical beams and at another end of said two support side beams, another one pair of said tension springs have one end fixed on said support cantilever at said another end of said two support side beams.

4. A method using the enclosed stirring machine for mixture materials using intermittent resonance according to claim 3, comprising the steps of:

Step 1: obtaining a total natural frequency F' of a material with a height H and said enclosed container by;

Step 1-1: transporting water and raw materials at liquid state to said enclosed container until reaching the height H, at this time blocking a tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

and

-continued $$m_{Liquid} = \rho_{Liquid} d\left(r^2 \arccos\frac{r-H}{r} - \sqrt{2rH - H^2}\,(r-H)\right),$$

where ρliquid refers to a density of liquid inside the enclosed container, d refers to a length of a thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by;

Step 3-1: obtaining a total mass m of the eccentric motor and the curve-shaped cushion pad through measuring test; and Step 3-2: determining the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activation an on/off switch of the eccentric motor so that the rotational speed R is reached, then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: turning off the on/off switch of the eccentric motor, determining an optimal control coefficient through actual tests so as to control an intermittent power-on time τ of the eccentric motor by;

Step 5-1: measuring the time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time τ of the eccentric motor; according to τ≠t, τ=at, where a refers to control coefficient and its value is (0.8<a<1.2), determine the optimal value of the control coefficient $a_{fit}$ through processing actual test, then determine the intermittent power-on time τ of the eccentric motor;

Step 6: turning on the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time τ of the eccentric motor is used to control the on and off of the eccentric motor to achieve the intermittent resonance and materials feeding.

5. The enclosed stirring machine for mixture materials using intermittent resonance according to claim 2, characterized in that: said one pair of parallel support cantilever, said four parallel support vertical beams and said two parallel support side beams of said fixed support frame are made of steel, said fixed plate is made of solid steel plate and is welded between said two support vertical beams.

6. A method using the enclosed stirring machine for mixture materials using intermittent resonance according to claim 5, comprising the steps of:

Step 1: obtaining a total natural frequency F' of a material with a height H and said enclosed container by; Step 1-1: transporting water and raw materials at liquid state to said enclosed container until reaching the height H, at this time block a tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

and $$m_{Liquid} = \rho_{Liquid} d\left(r^2 \arccos\frac{r-H}{r} - \sqrt{2rH - H^2}\,(r-H)\right),$$

where ρliquid refers to a density of liquid inside the enclosed container, d refers to a length of a thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by;

Step 3-1: obtaining a total mass m of the eccentric motor and the curve-shaped cushion pad through measuring test; and Step 3-2: determining the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activating an on/off switch of the eccentric motor so that the rotational speed R is reached, then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: turning off the on/off switch of the eccentric motor, determining an optimal control coefficient through actual tests so as to control an intermittent power-on time τ of the eccentric motor by;

Step 5-1: time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time T of the eccentric motor; according to τ≠t, τ=at, where a refers to control coefficient and its value is (0.8<a<1.2), determine the optimal value of the control coefficient $a_{fit}$ through processing actual test, then determine the intermittent power-on time τ of the eccentric motor;

Step 6: turning on the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time τ of the eccentric motor is used to control the on and off of the eccentric motor to achieve the intermittent resonance and materials feeding.

7. A method using the enclosed stirring machine for mixture materials using intermittent resonance according to claim 2, comprising the steps of:

Step 1: obtaining a total natural frequency F' of a material with a height H and said enclosed container by;

Step 1-1: transporting water and raw materials at liquid state to said enclosed container until reaching the height H, at this time blocking a tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

and $$m_{Liquid} = \rho_{Liquid} d\left(r^2 \arccos\frac{r-H}{r} - \sqrt{2rH - H^2}\,(r-H)\right),$$

where ρ liquid refers to a density of liquid inside the enclosed container, d refers to a length of a thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by;

Step 3-1: obtaining a total mass m of the eccentric motor and the curve-shaped cushion pad through measuring test; and Step 3-2: determining the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activating an on/off switch of the eccentric motor so that the rotational speed R is reached, then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: off the on/off switch of the eccentric motor, determining an optimal control coefficient through actual tests so as to control an intermittent power-on time τ of the eccentric motor by;

Step 5-1: measuring the time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time τ of the eccentric motor; according to τ≠t, τ=at, where a refers to control coefficient and its value is (0.8<a<1.2), determine the optimal value of the control coefficient $a_{fit}$ through processing actual test, then determine the intermittent power-on time τ of the eccentric motor;

Step 6: turning on the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time τ of the eccentric motor is used to control the on and off of the eccentric motor to achieve the intermittent resonance and materials feeding.

8. The enclosed stirring machine for mixture materials using intermittent resonance according to claim 1, characterized in that: further comprises a thin-walled cylinder body having one closed end at one end and one opening at another end; said closed end of said thin-walled cylinder body has a fertilizer input port and a water input port, said another end with said opening of said thin-walled cylinder body has is mounted with a closed tapered outlet, each of said two ends of said thin-walled cylinder body are connected to one pair of said tension springs respectively, and each one pair of said tension springs are mounted on said thin-walled cylinder body at a distance of a diameter of one end surface of said thin-walled cylinder body, said thin-walled cylinder body is made of transparent materials.

9. The enclosed stirring machine for mixture materials using intermittent resonance according to claim 1, characterized in that: further comprises a cart, said fixed support frame is placed on said cart; said cart comprises: a loading plate, a cart handle, a universal caster, a fixed brake caster, said fixed brake caster is mounted at one side of and below said loading plate, said universal caster is mounted at another side of and below said loading plate, said cart handle is mounted at one side of said loading plate, said fixed support frame is placed on said cart.

10. A method using the enclosed stirring machine for mixture materials using intermittent resonance according to claim 9, comprising the steps of:

Step 1: obtaining a total natural frequency F' of a material with a height H and said enclosed container by;

Step 1-1: transporting water and raw materials at liquid state to said enclosed container until reaching the height H, at this time blocking a tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

and $$m_{Liquid} = \rho_{Liquid} d\left(r^2 \arccos\frac{r-H}{r} - \sqrt{2rH - H^2}\,(r-H)\right),$$

where ρliquid refers to a density of liquid inside the enclosed container, d refers to a length of a thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by;

Step 3-1: obtaining a total mass m of the eccentric motor and the curve-shaped cushion pad through measuring test; and Step 3-2: determining the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activating an on/off switch of the eccentric motor so that the rotational speed R is reached, then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: turning off the on/off switch of the eccentric motor, determining an optimal control coefficient through actual tests so as to control an intermittent power-on time τ of the eccentric motor by:

Step 5-1: measuring the time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time τ of the eccentric motor; according to τ≠t, τ=at, where a refers to control coefficient and its value is (0.8<a<1.2), determine the optimal value of the control coefficient $a_{fit}$ through processing actual test, then determine the intermittent power-on time τ of the eccentric motor;

Step 6: turning on the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time τ of the eccentric motor is used to control the on and off of the eccentric motor to achieve the intermittent resonance and materials feeding.

11. The enclosed stirring machine for mixture materials using intermittent resonance according to claim 1, characterized in that: further comprising a cantilever pressure clamping device, said cantilever pressure clamping device is mounted on said fixed plate of said fixed support frame, said clamping end of said elastic cantilever beam is pressed tightly by said cantilever pressure clamping device, said movable end of said elastic cantilever beam is suspended directly below said enclosed container.

12. A method using the enclosed stirring machine for mixture materials using intermittent resonance according to claim 11, comprising steps of:

Step 1: obtaining a total natural frequency F' of a material with a height H and said enclosed container by;

Step 1-1: transporting water and raw materials at liquid state to said enclosed container until reaching the height H, at this time blocking a tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

and $$m_{Liquid} = \rho_{Liquid} d\left(r^2 \arccos\frac{r-H}{r} - \sqrt{2rH - H^2}\,(r-H)\right),$$

where ρliquid refers to a density of liquid inside the enclosed container, d refers to a length of a thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by; Step 3-1: obtaining a total mass m of the eccentric motor and the curve-shaped cushion pad through measuring test; and Step 3-2: determining the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activating an on/off switch of the eccentric motor so that the rotational speed R is reached, and then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: turning off the on/off switch of the eccentric motor, determining an optimal control coefficient through actual tests so as to control an intermittent power-on time τ of the eccentric motor by;

Step 5-1: measuring the time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time τ of the eccentric motor; according to τ≠t, τ=at, where a refers to control coefficient and its value is (0.8<a<1.2), determine the optimal value of the control coefficient $a_{fit}$ through processing actual test, then determine the intermittent power-on time τ of the eccentric motor;

Step 6: turning on the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time τ of the eccentric motor is used to control the on and off of the eccentric motor to achieve the intermittent resonance and materials feeding.

13. A method using the enclosed stirring machine for mixture materials using intermittent resonance according to claim 1, comprising the steps of:

Step 1: obtaining a total natural frequency F' of a material with a height H and said enclosed container by;

Step 1-1: transporting water and raw materials at liquid state to said enclosed container until reaching the height H, at this time blocking a tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

-continued and $$m_{Liquid} = \rho_{Liquid} d\left(r^2 \arccos\frac{r-H}{r} - \sqrt{2rH - H^2}\,(r-H)\right),$$

where ρliquid refers to a density of liquid inside the enclosed container, d refers to a length of a thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by,

Step 3-1: obtaining a total mass m of the eccentric motor and the curve-shaped cushion pad through measuring test; and Step 3-2: the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activating an on/off switch of the eccentric motor so that the rotational speed R is reached, then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: turning off the on/off switch of the eccentric motor, determining an optimal control coefficient through actual tests so as to control an intermittent power-on time τ of the eccentric motor by;

Step 5-1: the time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time τ of the eccentric motor; according to τ≠t, τ=at, where a refers to control coefficient and its value is (0.8<a<1.2), determine the optimal value of the control coefficient $a_{fit}$ through processing actual test, then determine the intermittent power-on time τ of the eccentric motor;

Step 6: turning the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time τ of the eccentric motor is used to control the on and off of the eccentric motor to achieve the intermittent resonance and materials feeding.

14. A method using the enclosed stirring machine for mixture materials using intermittent resonance according to claim 8, comprising the steps of:

Step 1: obtaining a total natural frequency F' of a material with a height H and said enclosed container by;

Step 1-1: transporting water and raw materials at liquid state to said enclosed container until reaching the height H, at this time blocking said tapered outlet of said enclosed container;

Step 1-2: obtaining the total natural frequency F' of the enclosed container and the liquid with the height H based on a suspension spring stiffness K, the height H of the liquid inside the enclosed container, a mass M of the enclosed container, and based on $$F = \frac{1}{2\pi}\sqrt{\frac{K}{M + m_{Liquid}}}$$

and $$m_{Liquid} = \rho_{Liquid} d\left(r^2 \arccos\frac{r-H}{r} - \sqrt{2rH - H^2}\,(r-H)\right),$$

where ρliquid refers to a density of liquid inside the enclosed container, d refers to a length of the thin-walled cylinder body of the enclosed container, r refers to an inner cavity radius of the enclosed container; and Step 1-3: If the raw material being added is a mixture of liquid and solid or a mixture of solid and solid, the mixture can be weighed first and a total mass after mixing can be obtained, then the total natural frequency can be obtained by using formula $$F = \frac{1}{2\pi}\sqrt{\frac{K}{M + m_{total}}};$$

Step 2: based on R=60F, determining a real-time rotational speed R of the eccentric motor; establishing a relationship between the rotational speed R and the height H of the raw materials inside the enclosed container by the step 1, and calibrating height values for the thin-walled cylinder body of the enclosed container, if the mixture inside the enclosed container is solid, a relationship between the height of the enclosed container and the rotational speed of the eccentric motor can be determined by field test according to a size and mass of the thin-walled cylinder body and the mass of the solid mixture contained therein;

Step 3: determining a length L of the elastic cantilever beam by;

Step 3-1: obtaining a total mass m of the eccentric motor and the curve-shaped cushion pad through measuring test; and Step 3-2: determining the length L of the elastic cantilever beam according to a formula $$F = \frac{1}{2\pi}\sqrt{\frac{3EJ}{L^3 m}},$$

where E is an elastic modulus of the elastic cantilever beam, J is a moment of inertia of the section since the natural frequency of the elastic cantilever beam needs to be equal to the total natural frequency F of the enclosed container and the contained materials, then adjusting the cantilever pressure clamping device so that the length of the elastic cantilever beam at its vibration end is the determined value L;

Step 4: After step 3, activating an on/off switch of the eccentric motor so that the rotational speed R is reached, then the elastic cantilever beam reaches a resonance state, and through the curve-shaped cushion pad at the moveable end of the elastic cantilever beam reciprocally hitting the enclosed container at the bottom side of the tail portion, the enclosed container is shaken up and down for providing a stirring effect, and after a period of time, a stable up and down shaking and stirring state is reached;

Step 5: turning off the on/off switch of the eccentric motor, determining an optimal control coefficient through actual tests so as to control an intermittent power-on time T of the eccentric motor by;

Step 5-1: measuring the time t required from turning off of the eccentric motor to attenuation of the elastic cantilever beam to an amplitude of 0 at a point after the on/off switch of the eccentric motor is turned off and the elastic cantilever beam is free to attenuate the vibration, and Step 5-2: setting the intermittent power-on time $\tau$ of the eccentric motor; according to $\tau \neq t$, $\tau = at$, where a refers to control coefficient and its value is $(0.8<a<1.2)$, determine the optimal value of the control coefficient $a_{fit}$ through processing actual test, then determine the intermittent power-on time $\tau$ of the eccentric motor;

Step 6: turning on the eccentric motor again so that the eccentric motor starts to operate at the rotational speed R, through the elastic cantilever beam hitting on the enclosed container until the enclosed container is shaking up and down steadily while the raw materials are stirred uniformly, opening the tapered outlet of the enclosed container, in a process of feeding raw materials, through observing a decrease in the height H of the raw materials, real-time observing the height H of the liquid level of the thin-walled cylinder body according to step 2 to adjust the rotational speed of the eccentric motor, and the intermittent power-on time $\tau$ of the eccentric motor is used to control the on and off of the eccentric motor to achieve the intermittent resonance and materials feeding.

* * * * *